US011120821B2

(12) United States Patent
Schiro

(10) Patent No.: US 11,120,821 B2
(45) Date of Patent: Sep. 14, 2021

(54) VOWEL SENSING VOICE ACTIVITY DETECTOR

(71) Applicant: Plantronics, Inc., Santa Cruz, CA (US)

(72) Inventor: Arthur Leland Schiro, Santa Cruz, CA (US)

(73) Assignee: Plantronics, Inc., Santa Cruz, CA (US)

( * ) Notice: Subject to any disclaimer, the term of this patent is extended or adjusted under 35 U.S.C. 154(b) by 778 days.

(21) Appl. No.: 15/231,228

(22) Filed: Aug. 8, 2016

(65) Prior Publication Data

US 2018/0040338 A1 Feb. 8, 2018

(51) Int. Cl.

| | |
|---|---|
| ***G10L 25/87*** | (2013.01) |
| ***G10K 11/175*** | (2006.01) |
| ***G10L 25/93*** | (2013.01) |
| ***G10L 25/78*** | (2013.01) |
| ***G10L 21/0232*** | (2013.01) |
| ***G10L 21/0308*** | (2013.01) |
| *G10L 21/0208* | (2013.01) |

(52) U.S. Cl.

CPC ..... *G10L 25/87* (2013.01); *G10K 11/1752* (2020.05); *G10L 21/0232* (2013.01); *G10L 21/0308* (2013.01); *G10L 25/78* (2013.01); *G10L 25/93* (2013.01); *G10L 2021/02085* (2013.01)

(58) Field of Classification Search

CPC . G10L 25/87; G10L 21/0308; G10L 21/0232; G10L 2021/02085; G10K 11/175

USPC ..... 704/233

See application file for complete search history.

(56) References Cited

U.S. PATENT DOCUMENTS

| | | | | |
|---|---|---|---|---|
| 3,479,460 | A * | 11/1969 | Clapper | G10L 19/02 704/208 |
| 6,424,942 | B1 * | 7/2002 | Mustel | G10L 19/012 704/216 |
| 7,146,013 | B1 * | 12/2006 | Saito | H04R 3/005 381/92 |
| 7,171,357 | B2 | 1/2007 | Boland | |
| 8,964,998 | B1 * | 2/2015 | McClain | H03G 3/32 381/57 |
| 2002/0164013 | A1 * | 11/2002 | Carter | H04M 3/40 379/387.02 |
| 2006/0109983 | A1 | 5/2006 | Young et al. | |

(Continued)

FOREIGN PATENT DOCUMENTS

| | | | |
|---|---|---|---|
| JP | 2014199445 | A | 10/2014 |
| WO | WO 2016/0007528 | A1 | 1/2016 |

OTHER PUBLICATIONS

International Search Report and Written Opinion dated Oct. 18, 2017, for international application No. PCT/US2017/044971, 10 pages.

(Continued)

*Primary Examiner* — Edwin S Leland, III

(74) *Attorney, Agent, or Firm* — Chuang Intellectual Property Law; Thomas Chuang

(57) ABSTRACT

Methods and apparatuses for detecting user speech are described. In one example, a method for detecting user speech includes receiving a microphone output signal corresponding to sound received at a microphone and identifying a spoken vowel sound in the microphone signal. The method further includes outputting an indication of user speech detection responsive to identifying the spoken vowel sound.

12 Claims, 11 Drawing Sheets

(56) References Cited

U.S. PATENT DOCUMENTS

| | | | | |
|---|---|---|---|---|
| 2008/0103761 | A1 | 5/2008 | Printz et al. | |
| 2009/0112579 | A1* | 4/2009 | Li | G10L 21/0208 704/205 |
| 2009/0222258 | A1 | 9/2009 | Fukuda et al. | |
| 2011/0002477 | A1 | 1/2011 | Zickmantel | |
| 2013/0185061 | A1 | 7/2013 | Arvanaghi et al. | |
| 2013/0231932 | A1 | 9/2013 | Zakarauskas et al. | |
| 2013/0282372 | A1 | 10/2013 | Visser et al. | |
| 2015/0243297 | A1* | 8/2015 | Benway | H04K 3/825 704/226 |
| 2016/0163334 | A1* | 6/2016 | Suzuki | G10L 21/0388 704/209 |
| 2017/0133041 | A1* | 5/2017 | Mortensen | G10L 25/15 |
| 2017/0169828 | A1* | 6/2017 | Sachdev | G10L 17/04 |
| 2018/0040338 | A1* | 2/2018 | Schiro | G10L 25/93 |

OTHER PUBLICATIONS

Segbroeck et al., "A robust frontend for VAD: exploiting contextual, discriminative and spectral cues of human voice," *INTERSPEECH*, Aug. 2013, pp. 704-708.

Granqvist et al., "The Correlogram: a visual display of periodicity," *Journal of the Acoustical Society of America*, 2003, 114(5):2934-2945.

European Search Report and Examination Report issued in corresponding European Application No. EP 17 84 0030, completed Jan. 24, 2020 (5 pages).

* cited by examiner

VOWEL SENSING VOICE ACTIVITY DETECTOR

BACKGROUND OF THE INVENTION

Voice activity detection (VAD) is useful in a variety of contexts. Existing systems and methods may detect voice activity based on sound level. For example, the indicative signal characteristic utilized by these systems is that a signal containing voice is composed of a persistent background noise that is interrupted by short periods of louder noises that correspond to voice sounds. Problematically, sound level based VAD systems often generate false positives, indicating voice activity in the absence of voice activity. For example, false positives in a sound level based VAD system may result from detection of sounds that are louder than the background noise level but are not voice sounds. Such sounds may include doors closing, keys being dropped on desks, and keyboard typing. As a result, improved methods and apparatuses for voice activity detection are needed.

BRIEF DESCRIPTION OF THE DRAWINGS

The present invention will be readily understood by the following detailed description in conjunction with the accompanying drawings, wherein like reference numerals designate like structural elements.

DESCRIPTION OF SPECIFIC EMBODIMENTS

Figure 1:
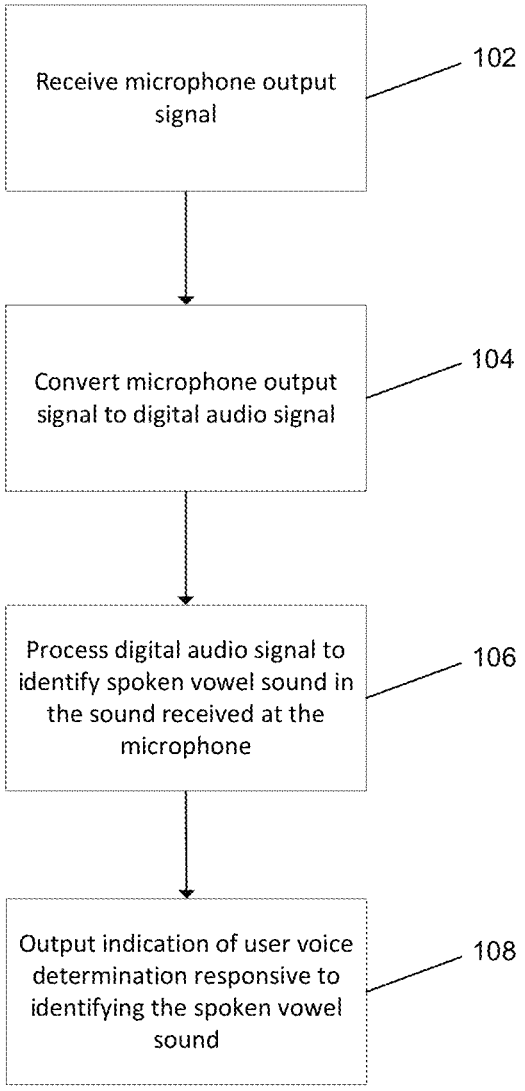
FIG. 1 is a flow diagram illustrating vowel detection based voice activity detection in one example.

Methods and apparatuses for enhanced vowel based voice activity detection are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein.

Block diagrams of example systems are illustrated and described for purposes of explanation. The functionality that is described as being performed by a single system component may be performed by multiple components. Similarly, a single component may be configured to perform functionality that is described as being performed by multiple components. For purpose of clarity, details relating to technical material that is known in the technical fields related to the invention have not been described in detail so as not to unnecessarily obscure the present invention. It is to be understood that various example of the invention, although different, are not necessarily mutually exclusive. Thus, a particular feature, characteristic, or structure described in one example embodiment may be included within other embodiments unless otherwise noted.

There are a number of signal characteristics that are indicative of human voice. The majority of human speech consists of sequences of words. Words consist of sequences of syllables. Syllables consist of sequences of consonants and vowels.

Consonants are characterized as sounds that are made by using voice articulators, such as the tongue, lips and teeth, to interrupt the path that sound waves, generated by the vocal cords, must travel before the vocal cord sound energy passes out of the human voice system. Vowels are characterized as sounds that are made by allowing vocal cord sound energy to pass, relatively unimpeded, through the human vocal system.

In one example embodiment, a vowel based VAD sensor (also referred to herein as the "vowel sensor") utilizes the harmonicity of human voice signals that arises from the fact that vocal cord excitation (i.e., vocal chords vibrating back and forth) contains energy at a fundamental frequency (also referred to as a base frequency), called the glottal pulse, and also at harmonics of that fundamental frequency. The vowel sensor detects signals that contain harmonic frequency components, within a range of glottal pulse frequencies. These signals are then considered to be the result of the presence of intelligible human voice.

Since the vowel sensor detects human voice signal harmonicity originating from vocal cord excitation, and since this energy is most present in vowel sounds, the sensor may be considered to be a "vowel sensor". Unvoiced consonants are not detected by the vowel sensor because the unvoiced phones do not contain harmonically spaced frequency components. Many of the voiced consonants are not detected by the vowel sensor because the harmonic energy in these voiced phones is sufficiently attenuated by the voice articulators.

One advantage of the vowel sensor over the prior art sound level VAD sensor is that it does not interpret as human voice sounds that result from events such as doors closing, keys being put on desks and other non-harmonic noise sources, such as the masking noise played in the room by a sound masking system. In one example implementation of the vowel sensor, a signal is formed from a digitized microphone output signal by finding the circular autocorrelation of the absolute value of the short time hamming windowed audio spectrum. This signal is normalized, a non-linear median filter is used to further reduce the impact of stationary noise and then a measurement is taken on the result to determine the presence of voice.

In one example of the invention, the improved vowel based VAD method and apparatus is used by a sound masking system to detect and respond to the presence of human speech. An adaptive sound masking system installed in some area (e.g., an open space such as a large open office area where employees work in workstations or cubicles) utilizes a sensor that can report on the amount of undesirable noises in that area. The sound masking system uses the information from this sensor to make decisions on how to modify the masking sounds that it is playing. Intelligible human voice is one of the primary categories of disruptive noises that a sound masking system may wish to mask. One reason for this is that speech enters readily into the brain's working memory and is therefore highly distracting. Even speech at very low levels can be highly distracting when ambient noise levels are low. The inventor has recognized a sensor is needed that can detect specifically when intelligible human voice is present in a room.

The inventor has recognized that use of the inventive vowel sensor is particularly advantageous in sound masking system applications designed to reduce the intelligibility of speech in an open space. In particular, the inventive vowel sensor operation (i.e., the detection of a vowel sound in user speech) is directly correlated to the intelligibility of the user speech detected (i.e., the intelligibility of the vowel sound in the speech). The sound masking system output to reduce the intelligibility of speech can then be adjusted accordingly. Prior sound level based VAD techniques are inadequate to control masking noise output. Loud noises, like doors closing, keys being dropped on desks and even keyboard typing may be picked up by the system and interpreted as noises that need to be masked. It is undesirable to attempt to mask these single-occurrence non-voice events, and the focus should be on intelligible human voice that needs to be masked. The improved speech intelligibility sensing capability of the vowel sensor results in improved performance and efficacy of the sound masking system. In one embodiment, the vowel based VAD sensor includes a ceiling mounted microphone connected to a sound card that amplifies and digitizes the microphone signal so that it can be processed by a vowel based VAD algorithm.

Advantageously, in one example the vowel sensor amplifies all signal components that are harmonic in nature and attenuates all signal components that are characterized as being stationary noise. Since the masking noise consists of primarily stationary noise, the vowel sensor is not impacted by the amount of masking noise being played by the sound masking system. In other words, the vowel sensor can "see though" the sound masking noise.

Furthermore, in one example the vowel sensor utilizes the energy in all harmonic frequency components, not just the harmonic frequency component that has the most energy. This is advantageous because the vowel sensor will still be effective in office environments that contain very loud low frequency noises originating from HVAC systems. In one example, the vowel sensor filters out the low frequency noises, thereby removing the HAVAC noise and, consequently, the large amplitude low frequency voice harmonics, and still maintains accurate detection of voice due to the presence of energy in many higher frequency harmonics. In other words, whenever an environment contains disruptive acoustic energy in specific frequency bands, this energy can be removed without breaking the vowel sensor algorithm.

In one example embodiment, a method for detecting user speech (also referred to herein as "voice activity") includes receiving a microphone output signal corresponding to sound received at a microphone, and converting the microphone output signal to a digital audio signal. The method includes identifying a spoken vowel sound in the sound received at the microphone from the digital audio signal. The method further includes outputting an indication of user speech detection responsive to identifying the spoken vowel sound.

In one example embodiment, a system includes a microphone arranged to detect sound in an open space and a speech detection system. The speech detection system includes a first module configured to convert the sound received at the microphone to a digital audio signal. The speech detection system further includes a second module configured to identify a spoken vowel sound in the sound received at the microphone from the digital audio signal and output an indication of user speech responsive to identifying the spoken vowel sound. In addition to the microphone and the speech detection system, the system further includes a sound masking system configured to receive the indication of user speech detection from the speech detection system and output or adjust a sound masking noise into the open space responsive to the indication of user speech.

In one example embodiment, one or more non-transitory computer-readable storage media having computer-executable instructions stored thereon which, when executed by one or more computers, cause the one more computers to perform operations including receiving a microphone output signal corresponding to sound received at a microphone and converting the microphone output signal to a digital audio signal. The operations include identifying a spoken vowel sound in the sound received at the microphone from the digital audio signal. The operations further include outputting an indication of user speech detection responsive to identifying the spoken vowel sound.

FIG. 1 is a flow diagram illustrating a process for vowel detection based voice activity detection (VAD) in one example. For example, the process illustrated may be implemented by the system 400 shown in FIG. 4. At block 102, a microphone output signal corresponding to sound received at a microphone is received. At block 104, the microphone output signal is converted to a digital audio signal.

At block 106, the digital audio signal is processed to identify a spoken vowel sound in the sound received at the microphone. In one example, identifying a spoken vowel sound in the sound received at the microphone includes detecting or amplifying harmonic frequency signal components. For example, the harmonic frequency signal components include energy in a plurality of higher frequency harmonics.

In one example, identifying a spoken vowel sound in the sound received at the microphone includes finding a circular autocorrelation of the absolute value of a short time hamming windowed audio spectrum. The impact of stationary noise is then reduced by applying a non-liner median filter to the result of the circular autocorrelation of the absolute value of the short time hamming windowed audio spectrum.

At block 108, an indication of user speech detection is output responsive to identifying the spoken vowel sound. In one example, the process may further include filtering out low frequency stationary noise present in the sound. For example, the stationary noise may include heating, ventilation, and air conditioning (HVAC) noise, which is present below 300 Hz.

In one example, the process may further include outputting a stationary noise including a sound masking noise in an open space, where the microphone is disposed in proximity to a ceiling area (e.g., just below or just above) of the open space and the sound masking sound is present in the sound received at the microphone. The sound masking noise present in the sound does not impede the VAD from accurately identifying the spoken vowel sound (i.e., accurate identification of the spoken vowel sound is immune to the presence of the sound masking noise).

Figure 2:
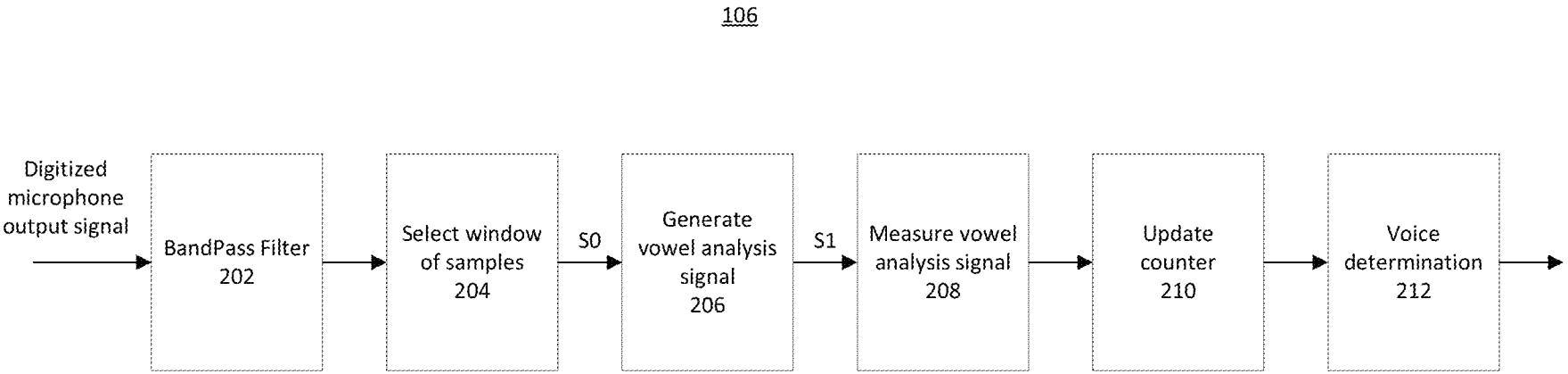
FIG. 2 illustrates a process for identifying spoken vowel sounds referred to in FIG. 1.

FIG. 2 illustrates one example of the process for identifying spoken vowel sounds at block 106 referred to in FIG. 1. In one example, microphone samples are captured at a sample rate of 16 kHz. At block 202, samples are filtered using a band pass filter with a lower break frequency of 300 Hz and a high break frequency of 2 kHz. The band pass filtering removes all energy below 300 Hz and above 2 kHz. This energy includes any HVAC noise, which is stationary in nature and falls below 300 Hz.

At block 204, the samples are selected by being divided into overlapping windows. In one example, the window duration is 100 ms and the time delay between windows is 20 ms. In this example, the selected signal window is referred to as signal0 ("S0") and output to block 206. At block 206, each sample window is transformed (i.e., converted) to generate a vowel analysis signal. In this example, the vowel analysis signal output from block 206 to block 208 is referred to as signal1 ("S1").

At block 208, a measurement is taken on the vowel analysis signal. At block 210, the measurement's value is used to determine how to update (i.e., adjust) a counter. In one example, if the measurement is above a predefined threshold, the counter is incremented by a predefined amount and if it is below the measurement threshold the counter is decremented by a predefined amount. At block 212, a voice determination is made. In one example, voice is considered to be present whenever the counter value is above a predefined counter threshold.

Figure 3:
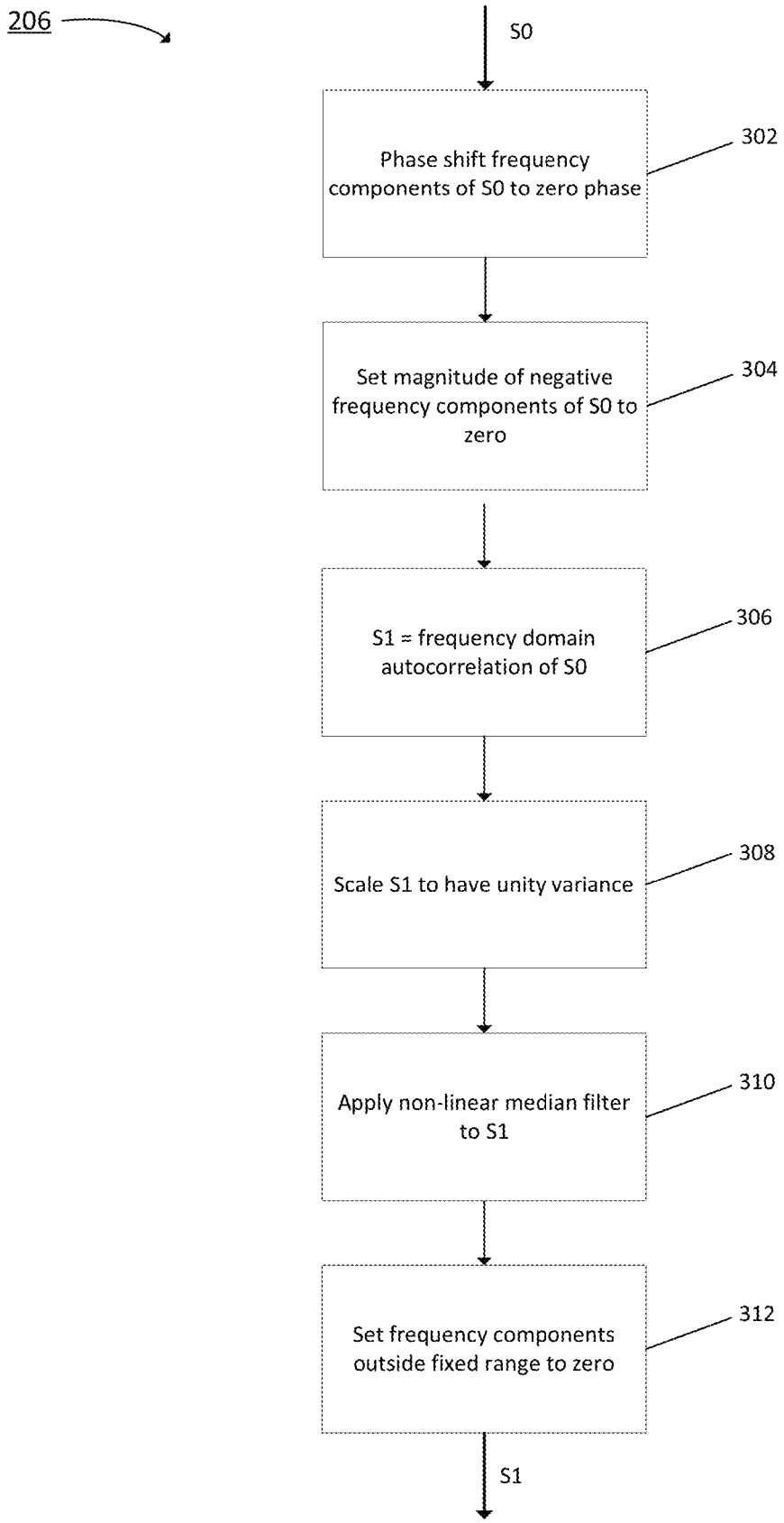
FIG. 3 illustrates a process for generating the vowel analysis signal referred to in FIG. 2.

FIG. 3 illustrates one example of the process for generating the vowel analysis signal at block 206 referred to in FIG. 2. At block 302, the frequency components of signal0 are phase shifted so that they have zero phase. At block 304, the magnitude of the negative frequency components of signal0 are set to zero.

At block 306, signal1 is equal to the frequency domain autocorrelation of signal0. At block 308, signal1 is scaled to have unity variance. At block 310, a non-linear median filter is applied to signal1 in such a way that small sections of signal1, that do not contain energy from voice harmonics, have a mean value of zero. At block 312, all frequency components outside a fixed range are set to have a value of zero. Signal1 is then output from block 312 to block 208 shown in FIG. 2. In one example, the processes shown in FIG. 3 may be implemented as follows.

A Hamming window is applied to the signal0 (referred to below as x0, a 100 ms section of microphone samples):

$$w = 0.54 - 0.46 * \cos\left(2\pi \frac{n}{N}\right),\ 0 \le n \le N - 1$$

where w is a periodic hamming window and where N is the number of samples in the window.

The result is converted into the frequency domain using the discrete Fourier transform (DFT):

$$x1 = x0 * w$$

$$x2 = \mathrm{DFT}(x1)$$

The converted samples are now complex. These complex values are replaced by their magnitudes (e.g., block 302 in FIG. 3):

$$x3 = \mathrm{abs}(x2)$$

The samples to the right of the Nyquist component are set to zero (e.g., block 304 in FIG. 3):

$$x3[k] = 0,\ \frac{N}{2} + 1 \le k \le N$$

This signal is converted back into the time domain via the inverse DFT (e.g., block 306 in FIG. 3):

$$x4 = \mathrm{DFT}^{-1}(x3)$$

This time domain signal is now complex. The samples in this signal are multiplied by their conjugates (e.g., block 306 in FIG. 3):

$$x5 = x3 * x3*$$

A hamming window is applied to the result and the signal is converted into the frequency domain via the DFT (e.g., block 306 in FIG. 3):

$$x6 = x5 * w$$

$$x7 = \mathrm{DFT}(X6)$$

The signal samples are divided by the standard of deviation of the signal (e.g., block 308 in FIG. 3):

$$\sigma = \sqrt{\frac{\sum_n x7[n]^2}{N}}$$

$$x8 = x7/\sigma$$

A temporary signal is create by applying an $11^{th}$ order median filter to the signal (e.g., block 310 in FIG. 3):

$$x9 = \mathrm{medianfilter}_{11}(x8)$$

The signal is altered by having the temporary signal subtracted from it (e.g., block 310 in FIG. 3):

$$x10 = x8 - x7$$

All signal components corresponding to frequencies below 80 Hz and above 2000 Hz are set to zero (e.g., block 312 in FIG. 3):

$$x10[k] = 0, \text{index corresponding to } 2000\ Hz < k < \text{index corresponding to } 80\ Hz$$

One example of the process for taking a measurement on the vowel analysis signal at block 208 referred to in FIG. 2 is as follows:

A value val1 is created by adding together the square of all signal components with value greater than zero:

$$val1 = \sum_k y0^2,\ y0[k] > 0$$

where yo is the vowel analysis signal.

A value val2 is created by adding together the square of all signal components with value less than zero:

$$val2 = \sum_k y0^2,\ y0[k] < 0$$

A value val3 is created by subtracting value2 from value1:

$$val3 = val1 + val2$$

The measurement value is created by dividing value3 by the number of signal components corresponding to frequencies above 80 Hz and below 2000 Hz.

$$\text{Measurement value} = \frac{val3}{\text{scale}}$$

where scale=the number of signal indices corresponding to frequency components between 80 Hz and 2000 Hz.

Figure 4:
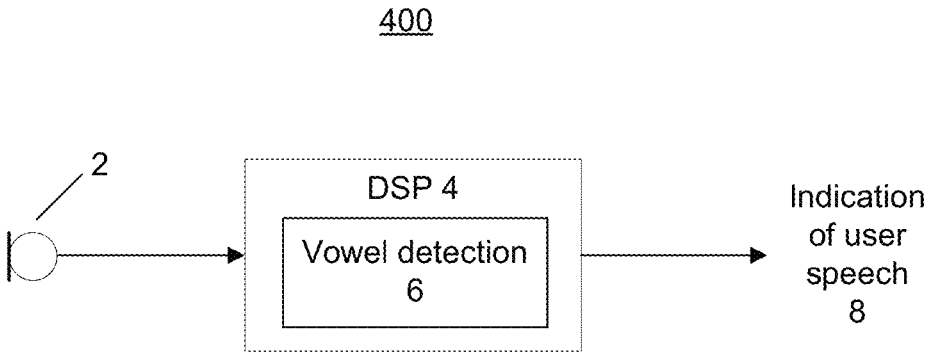
FIG. 4 illustrates a simplified block diagram of a system for vowel detection based voice activity detection in one example.

FIG. 4 illustrates a simplified block diagram of a system 400 for vowel detection based voice activity detection in one example. System 400 includes a microphone 2 and a digital signal processor (DSP) 4. DSP 4 executes vowel detection processes 6. DSP 4 outputs an indication of user speech 8 (e.g., present or not present). In one example, vowel detection processes 6 are as described above in reference to FIGS. 1-3.

In one example implementation, microphone 2 is an omnidirectional beyerdynamic (BM 33 B) microphone to detect audio signals and DSP 4 is implemented at a Focusrite Scarlett 6i6 soundcard to sense and digitize the audio signals. In one example, vowel detection processes 6 consist of an algorithm of various mathematical operations performed on the digitized audio signal in order to determine if intelligible voice is present in the signal. In one example, a matlab script is implemented to capture and process audio samples from the sound card. The output of the processing algorithm is a digital time-domain boolean signal that takes on a value of "true" for points in time where intelligible speech is sensed and a value of "false" for points in time when speech is not sensed.

In one example implementation, after samples are acquired from the sound card, they are passed to a voice activity detection (VAD) manager object. The VAD manager performs a sequence of preprocessing steps and then hands the conditioned samples to the vowel detection algorithms for processing. The preprocessing steps performed by this VAD manager are (1) A sample rate of 16 kHz is used to collect audio samples, (2) The samples are passed through a $7^{th}$ order infinite impulse response (IIR) Butterworth high pass filter (HPF) with break frequency of 300 Hz. This HPF is necessary in order to remove the heating, ventilation and air conditioning (HVAC) noise found at low frequencies and in great abundance in the office setting, and (3) The samples are passed through a $4^{th}$ order IIR Butterworth low pass filter (LPF) with break frequency of 2 kHz. Although voice audio does contain information above 2 kHz, it is desirable to reduce the bandwidth (BW) of the signal as much as possible in order to improve the signal to noise ratio (SNR).

Figure 6:
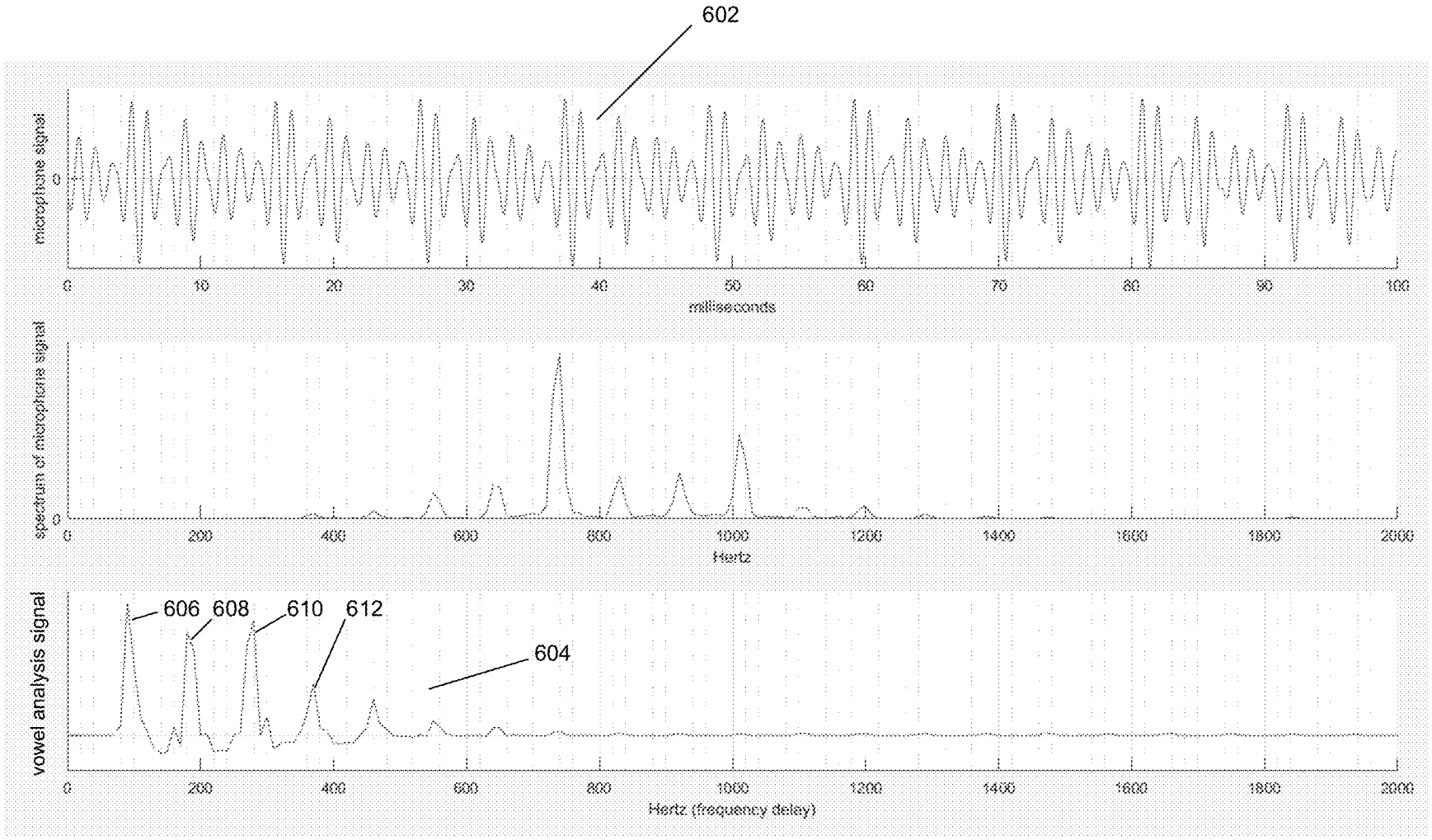
FIG. 6 illustrates a microphone output signal after the application of a band pass filter with break frequencies at 300 Hz and 2000 Hz and a corresponding generated vowel analysis signal in a scenario where voice is present.

FIG. 6 illustrates a band pass filtered microphone output signal 602 and a corresponding generated vowel analysis signal 604 in a scenario where voice is present. Vowel analysis signal 604 is generated as described above in reference to FIGS. 1-3. In this example, band pass filtered microphone output signal 602 is an output of microphone 2 following detection of user speech in the presence of the vowel "a", which is the first syllable in "opera" and is also defined as the "open back unrounded vowel." Advantageously, the processes described above in FIGS. 1-3 amplify signal components which are harmonic in nature and attenuate all signal components that are characterized as being stationary noise, thereby generating vowel analysis signal 604. The generated vowel analysis signal 604 contains energy in multiple frequency harmonics 606, 608, 610, 612, etc., allowing these frequency harmonics to be utilized in the measurement of the vowel analysis signal 604 and voice determination described above.

Figure 5:
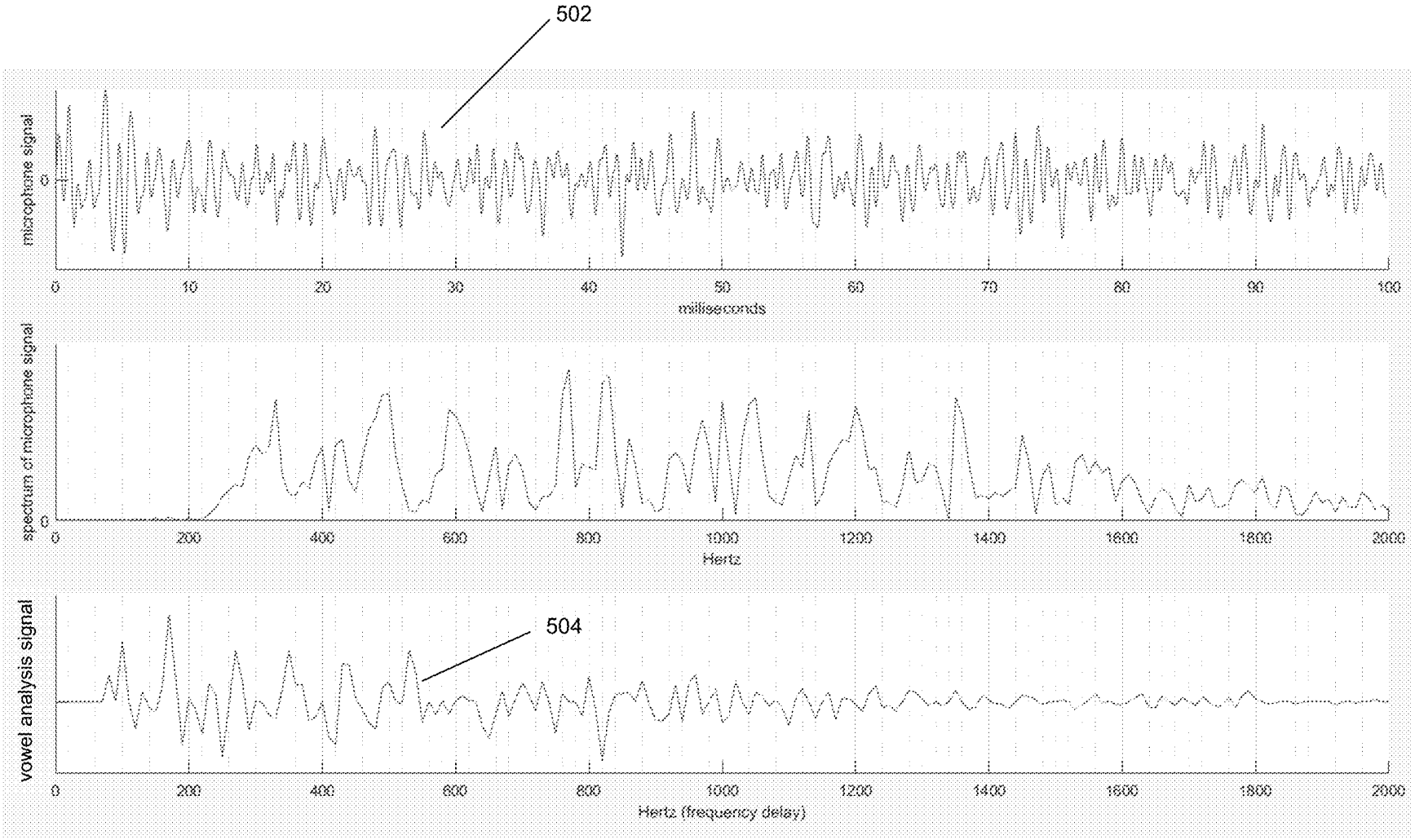
FIG. 5 illustrates a microphone output signal after the application of a band pass filter with break frequencies at 300 Hz and 2000 Hz and a corresponding generated vowel analysis signal in a scenario where no voice is present.

Vowel analysis signal 604 can be contrasted with vowel analysis signal 504, shown in FIG. 5. FIG. 5 illustrates a band pass filtered microphone output signal 502 and a corresponding generated vowel analysis signal 504 in a scenario where no speech is present. Vowel analysis signal 504 is generated as described above in reference to FIGS. 1-3. Since there is no speech, vowel analysis signal 504 does not show amplified signal components which are harmonic in nature. Measurement of vowel analysis signal 504 thereby results in a determination of no speech.

Figure 7:
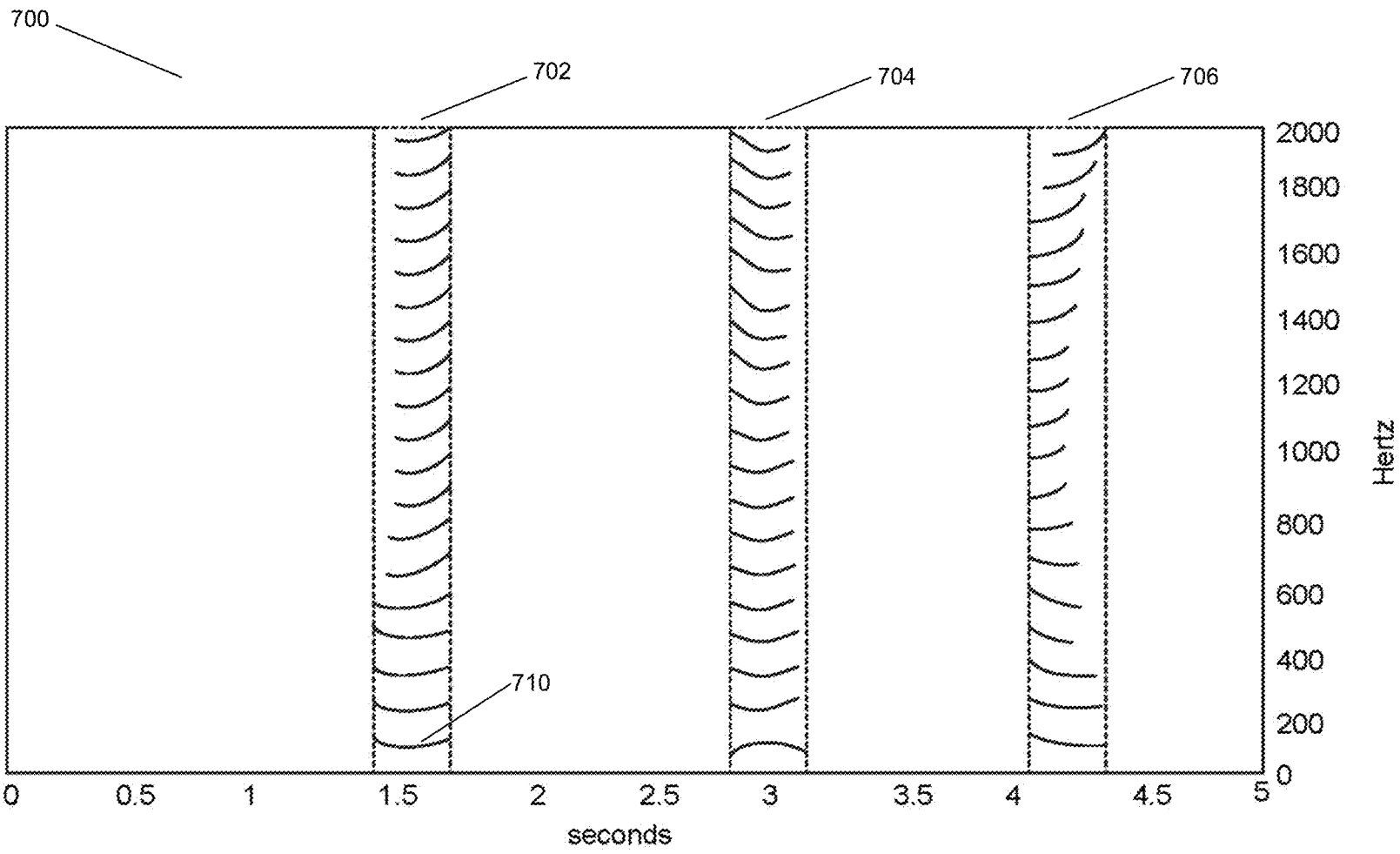
FIG. 7 illustrates variation of a vowel analysis signal over time in the presence of occasional speech.

FIG. 7 illustrates variation of a vowel analysis signal 700 over time in the presence of occasional speech 702, 704, and 706. In the example shown, the voice signal consists of a user speech counting "one, two, three" at approximately 1.5 seconds, 3 seconds, and just after 4 seconds. Plots 710 correspond to the amplitude of the vowel analysis signal at that location of time and frequency. The dotted lines show where the algorithm has detected voice.

Figure 8:
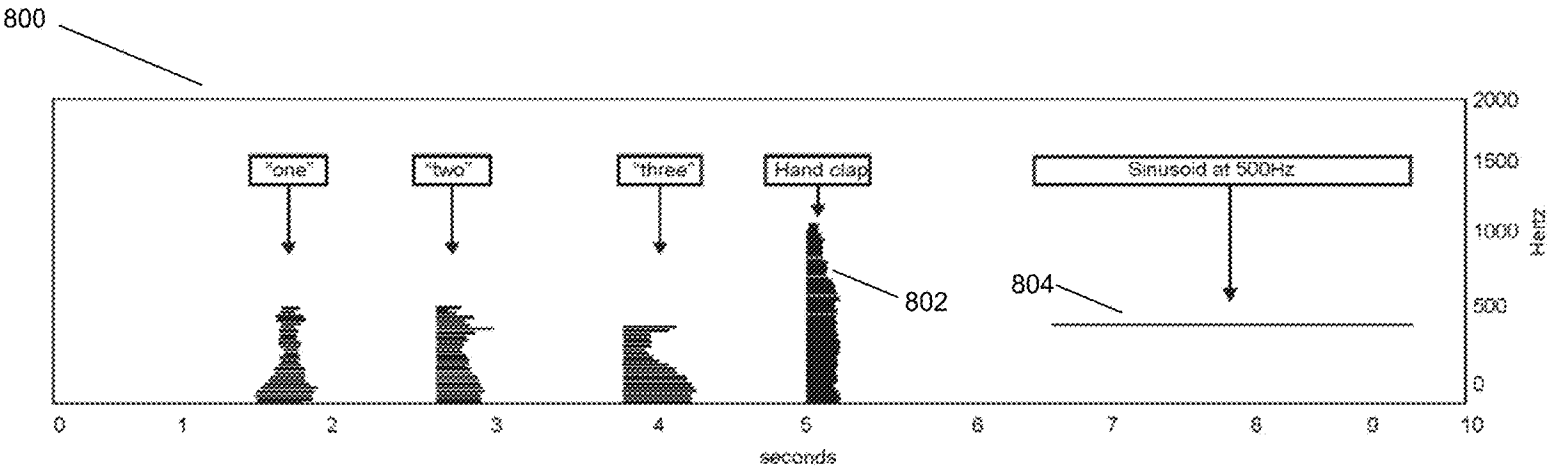
FIG. 8 illustrates a side-by-side view of a spectrogram in the presence of speech and other sounds over time and the resulting corresponding vowel analysis signal.
Figure 8:
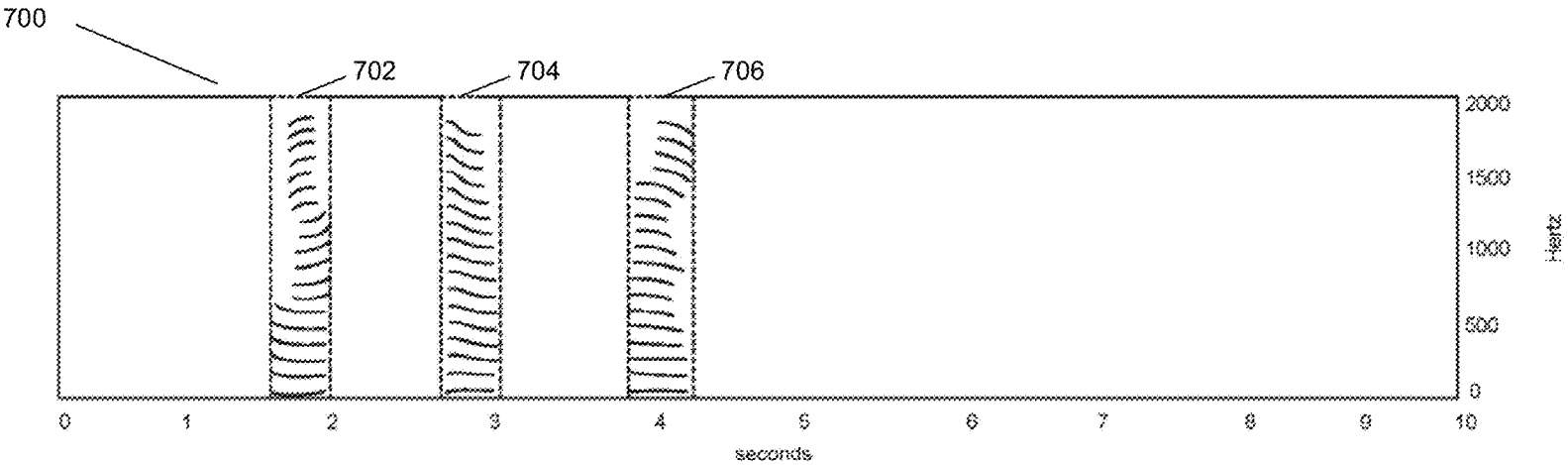

FIG. 8 illustrates a side-by-side view of a spectrogram 800 in the presence of speech and other sounds over time and the resulting corresponding vowel analysis signal 700. Other sounds shown in spectrogram 800 include a hand clap 802 and a sinusoid at 500 Hz 804. FIG. 8 illustrates that the generated vowel analysis signal 700 (i.e., the method used to generate) is advantageously immune to approximate acoustic impulses, since it does not get triggered by the hand clap 802 or monochromatic sounds (e.g., sinusoid 804).

Figure 9:
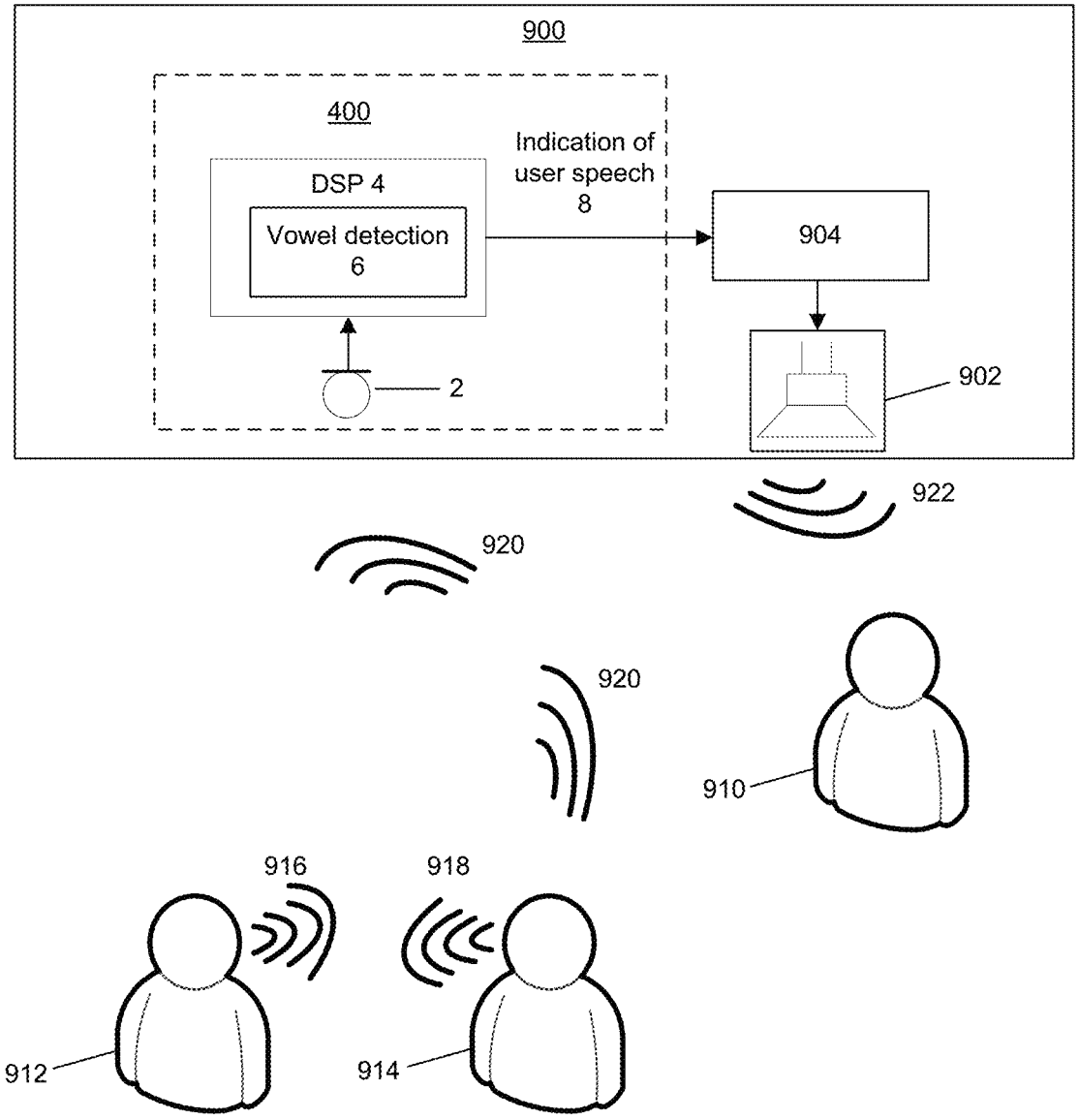
FIG. 9 illustrates a system and method for masking open space noise using vowel based voice activity detection in one example.

FIG. 9 illustrates a sound masking system and method for masking open space noise using vowel based voice activity detection in one example. As companies move to more open floor plans, the removal of sound isolation and absorption structures results in problems associated with the propagation of intelligible speech. Two concrete challenges introduced by the increased levels of intelligible speech in communal work spaces include: challenges associated with maintaining conversation confidentiality and challenges associated with maintaining focus in such a distracting environment.

One way of addressing the issues mentioned above involves filling open work spaces with some sort of sound that masks the conversations taking place in that space. This masking sound (also referred to herein as "masking noise") can take many different forms, including biophilic sounds, such as waterfalls and rainstorms, and filtered white noises, such as pink and brown noise.

A sound masking solution is implemented by installing ceiling mounted speakers which play masking sounds as dictated by a noise masking controller. This controller can be configured to play masking sounds at a fixed noise level. However, it is desirable to implement a noise masking controller that is capable of adjusting the making sound noise level so that it is set to an optimal level. The result is that the masking controller will play masking sound at a noise level proportional to the amount of intelligible speech in the work space.

In order to implement such a system, a sensor capable of reporting the presence of intelligible speech in a room is required. The use of the vowel based VAD described above in reference to FIGS. 1-4 is particularly advantageous to report the presence of intelligible speech in a room as discussed previously. The noise masking controller uses the output from the vowel based VAD to make decisions on what noise level to play the masking sound at.

Figure 10:
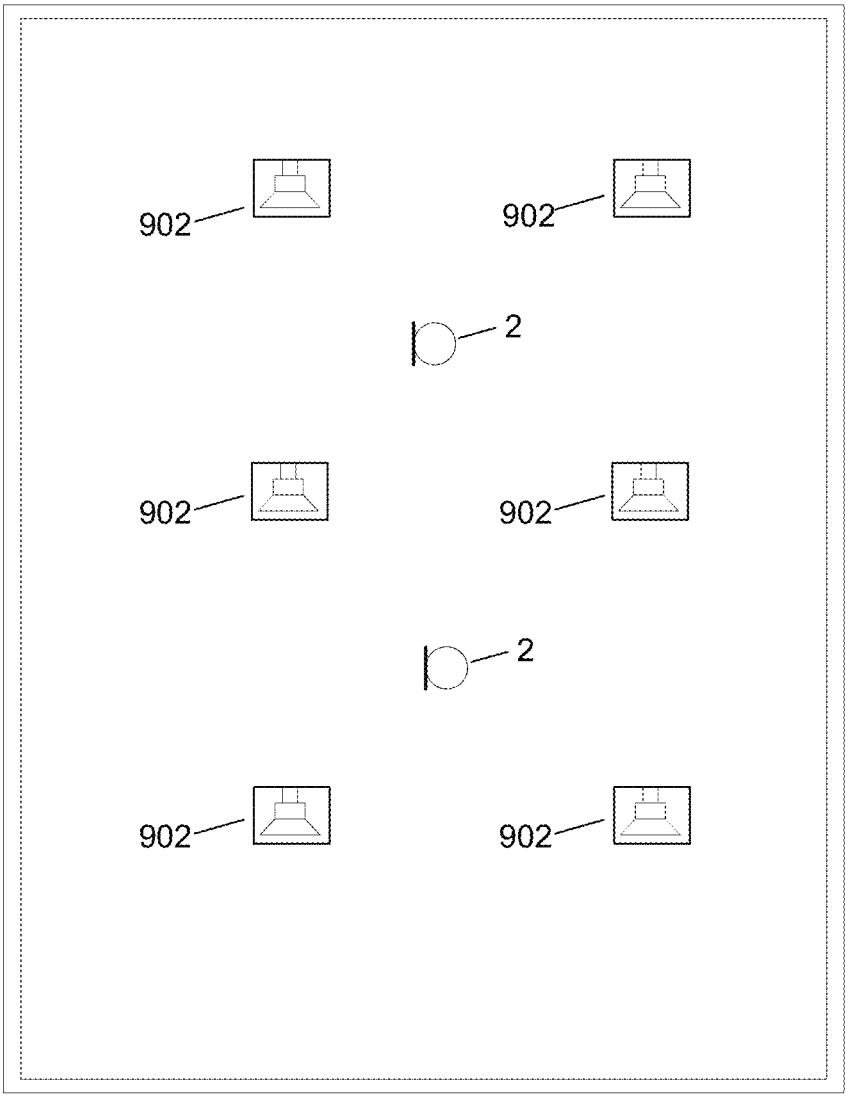
FIG. 10 illustrates placement of the speaker and microphone shown in FIG. 9 in an open space in one example.

In one example implementation, a sound masking system 900 includes a speaker 902, noise masking controller 904, and system 400 for vowel based VAD as described above in reference to FIG. 4. Speaker 902 is arranged to output a speaker sound including a masking noise 922 in an open space such as an office building room. FIG. 10 illustrates placement of a plurality of speakers 902 and microphones 2 shown in FIG. 9 in an open space 500 in one example. For example, open space 500 may be a large room of an office building in which employee cubicles are placed.

Figure 11:
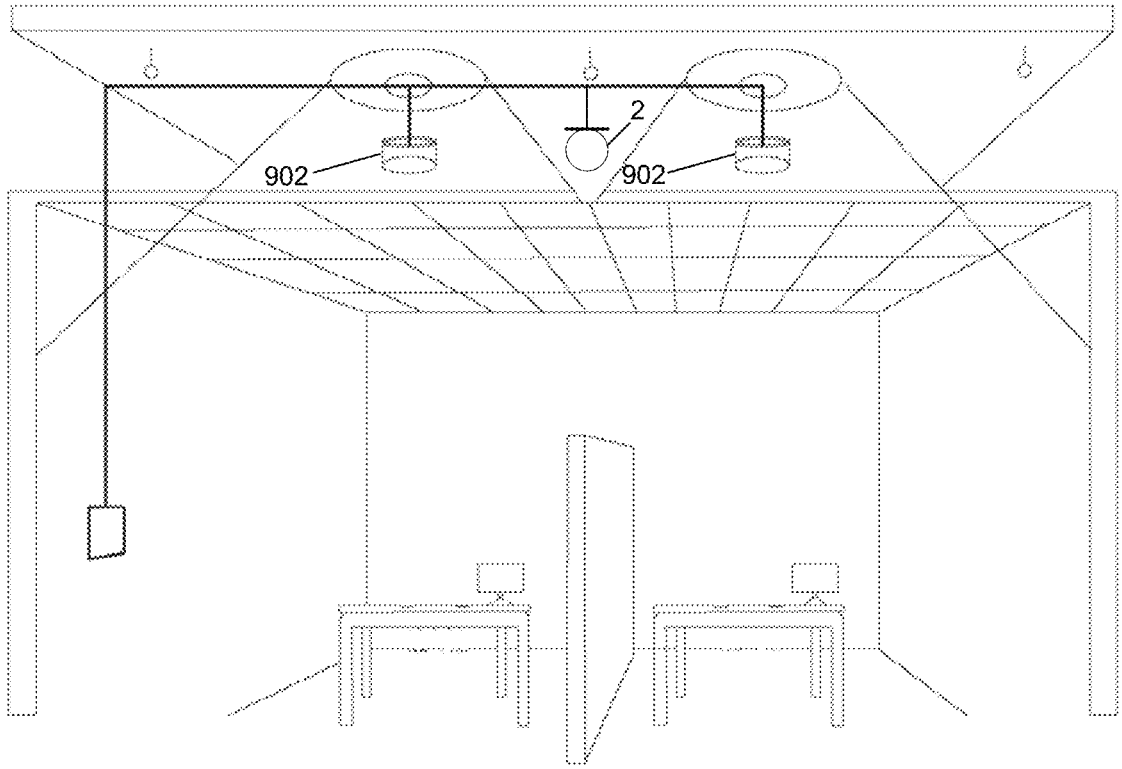
FIG. 11 illustrates placement of the speaker and microphone shown in FIG. 9 in one example.

Referring again to FIG. 9, masking noise 922 is a noise (e.g., random noise such as pink noise) or sound configured to mask intelligible speech or other open space noise. Masking noise 922 may also include other noise/sound operable to mask intelligible speech in addition to or in alternative to pink noise. Such sounds include, but are not limited to natural sounds, such as the flow of water. In one example, the speaker 902 is one of a plurality of loudspeakers which are disposed in a plenum above the open space. FIG. 11 illustrates placement of the speaker 902 and microphone 2 shown in FIG. 9 in one example. The masking noise 922 is then directed down into the open space.

Masking noise 922 is received from noise masking controller 904. In one example, noise masking controller 904 is an application program at a computing device, such as a digital music player playing back audio files containing a recording of the random noise.

Referring again to FIG. 9, in one example operation, sound 922 operates to mask open space sound 920 (i.e., open space noise) heard by a person 910. In the example shown in FIG. 9, a conversation participant 912 is in conversation with a conversation participant 914 in the vicinity of person 910 in the open space. Open space sound 920 includes components of speech 916 from participant 912 and speech 918 from conversation participant 914. The intelligibility of speech 916 and speech 918 is reduced by sound 922.

In one example operation, microphone 2 at system 400 is arranged to detect sound 920. System 400 converts the sound 920 received at the microphone 2 to a digital audio signal. Using processes described above in one example, system 400 identifies a spoken vowel sound in the sound 920 received at the microphone 2, and outputs an indication of user speech 8 responsive to identifying the spoken vowel sound. In one example, the system 400 finds a circular autocorrelation of the absolute value of a short time hamming windowed audio spectrum to identify the spoken vowel sound. System 400 may reduce the impact of stationary noise by applying a non-liner median filter to the result of this circular autocorrelation.

Sound masking system 900 receives the indication of user speech, and adjusts the volume of masking noise 922 output from speaker 902 responsive to the indication of user speech. For example, the volume of masking noise 922 is increased if the presence of intelligible speech is detected or the level of the intelligible speech increases.

In one example, the sound 920 received at the microphone 2 includes the masking noise 922 output from speaker 902, and the performance of the system 400 is not impeded by the masking noise 922. In one example, the sound 920 received at the microphone 2 includes a stationary noise and the performance of the system 400 filters out this low frequency stationary noise. For example, the stationary noise may include heating, ventilation, and air conditioning (HVAC) noise.

While the exemplary embodiments of the present invention are described and illustrated herein, it will be appreciated that they are merely illustrative and that modifications can be made to these embodiments without departing from the spirit and scope of the invention. Acts described herein may be computer readable and executable instructions that can be implemented by one or more processors and stored on a computer readable memory or articles. The computer readable and executable instructions may include, for example, application programs, program modules, routines and subroutines, a thread of execution, and the like. In some instances, not all acts may be required to be implemented in a methodology described herein.

Terms such as "component", "module", "circuit", and "system" are intended to encompass software, hardware, or a combination of software and hardware. For example, a system or component may be a process, a process executing on a processor, or a processor. Furthermore, a functionality, component or system may be localized on a single device or distributed across several devices. The described subject matter may be implemented as an apparatus, a method, or article of manufacture using standard programming or engineering techniques to produce software, firmware, hardware, or any combination thereof to control one or more computing devices.

Thus, the scope of the invention is intended to be defined only in terms of the following claims as may be amended, with each claim being expressly incorporated into this Description of Specific Embodiments as an embodiment of the invention.

What is claimed is:

1. A method for detecting user speech comprising:

outputting from a loudspeaker a sound masking noise in an open space;

detecting a sound in the open space with a microphone and outputting a microphone output signal corresponding to the sound, wherein the sound comprises the sound masking noise;

converting the microphone output signal to a digital audio signal;

identifying a spoken vowel sound in the sound received at the microphone from the digital audio signal comprising: detecting a plurality of harmonic frequency signal components; filtering out a low frequency component comprising the sound masking noise; and amplifying one or more higher frequency harmonics in the plurality of harmonic frequency signal components; and outputting an indication of user speech detection responsive to identifying the spoken vowel sound.

2. The method of claim 1, wherein filtering out the low frequency component comprising the sound masking noise comprises filtering out frequencies below 300 Hz present in the sound.

3. The method of claim 1, wherein the low frequency component further comprises at least one of a heating, ventilation, and air conditioning (HVAC) noise.

4. The method of claim 1, wherein identifying the spoken vowel sound in the sound received at the microphone from the digital audio signal comprises finding a circular autocorrelation of an absolute value of a short time hamming windowed audio spectrum.

5. The method of claim 4, further comprising reducing an impact of stationary noise by applying a non-linear median filter to a result of the circular autocorrelation of the absolute value of the short time hamming windowed audio spectrum.

6. A system comprising:

a sound masking system configured to output from a loudspeaker a sound masking noise in an open space;

a microphone arranged to detect a sound in the open space, the sound comprising the sound masking noise; and a speech detection system comprising:

a first module configured to convert the sound received at the microphone to a digital audio signal; and a second module configured to identify a spoken vowel sound in the sound received at the microphone from the digital audio signal and output an indication of user speech responsive to identifying the spoken vowel sound, wherein to identify the spoken vowel sound the second module is configured to: detect a plurality of harmonic frequency signal components; filter out a low frequency component comprising the sound masking noise; and amplify one or more higher frequency harmonics in the plurality of harmonic frequency signal components, and wherein the sound masking system is further configured to receive the indication of user speech from the speech detection system and output or adjust the sound masking noise into the open space responsive to the indication of user speech.

7. The system of claim 6, wherein the sound detected at the microphone further comprises at least one of a heating, ventilation, and air conditioning (HVAC) noise, and wherein the second module is further configured to filter out the at least one of the heating, ventilation, and air conditioning noise.

8. The system of claim 6, wherein the second module is configured to find a circular autocorrelation of an absolute value of a short time hamming windowed audio spectrum to identify the spoken vowel sound.

9. The system of claim 8, wherein the second module is further configured to reduce an impact of stationary noise by applying a non-linear median filter to a result of the circular autocorrelation of the absolute value of a short time hamming windowed audio spectrum.

10. One or more non-transitory computer-readable storage media having computer-executable instructions stored thereon which, when executed by one or more computers, cause the one more computers to perform operations comprising:

outputting from a loudspeaker a sound masking noise in an open space;

detecting a sound in the open space with a microphone and outputting a microphone output signal corresponding to the sound, wherein the sound comprises the sound masking noise;

converting the microphone output signal to a digital audio signal;

identifying a spoken vowel sound in the sound received at the microphone from the digital audio signal comprising: detecting a plurality of harmonic frequency signal components; filtering out a low frequency component comprising the sound masking noise; and amplifying one or more higher frequency harmonics in the plurality of harmonic frequency signal components; and outputting an indication of user speech detection responsive to identifying the spoken vowel sound.

11. The one or more non-transitory computer-readable storage media of claim 10, wherein the microphone is disposed in proximity to a ceiling area of the open space.

12. The one or more non-transitory computer-readable storage media of claim 10, wherein identifying the spoken vowel sound in the sound received at the microphone from the digital audio signal comprises finding a circular autocorrelation of an absolute value of a short time hamming windowed audio spectrum.

* * * * *